United States Patent [19]

Lindal

[11] Patent Number: 4,512,120

[45] Date of Patent: Apr. 23, 1985

[54] MODULAR HOME CONSTRUCTION

[76] Inventor: Sir W. Lindal, 1120 8th Ave., #1702, Seattle, Wash. 98101

[21] Appl. No.: 351,944

[22] Filed: Feb. 24, 1982

[51] Int. Cl.[3] ..... E04B 1/343

[52] U.S. Cl. ..... 52/79.1; 52/66; 52/143; 52/292

[58] Field of Search ..... 52/79.1, 79.4, 79.5, 52/66, 293, 143, 261, 204, 90, 289, 292

[56] References Cited

U.S. PATENT DOCUMENTS

| | | | |
|---|---|---|---|
| 3,407,548 | 10/1968 | Russell | 52/204 X |
| 3,638,373 | 2/1972 | Chapman | 52/79.5 X |
| 3,716,267 | 2/1973 | Lindsay | 52/143 X |
| 3,791,087 | 2/1974 | Sigal | 52/293 |
| 3,890,747 | 6/1975 | Van Der Lely | 52/79.5 X |
| 4,015,375 | 4/1977 | Lindsay | 52/143 |
| 4,058,941 | 11/1977 | Zakrzewski et al. | 52/261 X |
| 4,091,582 | 5/1978 | Lawrence | 52/79.7 |
| 4,283,890 | 8/1981 | Takeda et al. | 52/79.1 X |
| 4,439,957 | 4/1984 | Raasakka et al. | 52/693 |

FOREIGN PATENT DOCUMENTS

| | | | |
|---|---|---|---|
| 1562963 | 3/1969 | France | 52/143 |
| 985338 | 3/1965 | United Kingdom | 52/79.4 |

*Primary Examiner*—J. Karl Bell

[57] ABSTRACT

A modular home section or module whose floor system consists of trusses deep enough to extend below the frost line, having all portions that come in contact with the earth or lie within six (6) inches of the earth, resistant to decay or corrosion. Said module is box-like, consisting of the floor, the ceiling, three (3) outside walls and a marriage partition over which is attached a half roof and half gable component whose rafters are hinged to the eave wall, using bendable rafter ties as hinges and whose gables slide over the end walls when the roof is folded down for transportation purposes.

8 Claims, 11 Drawing Figures

MODULAR HOME CONSTRUCTION

FIELD OF INVENTION

This invention relates to transportable prefabricated homes having permanent foundations.

SUMMARY OF THE INVENTION

A prefabricated modular home is cost effective against conventional homes because it is factory made under ideal production conditions as compared with site construction. However, foundations are still conventionally built on the site, as are the under-floor plumbing, heating ducts and insulation. With the advent of the treated all-weather foundation, prefabricated foundation walls have been used, but like the concrete foundation, they must be installed before the main modules are delivered. I solved the problem by attaching soil resistant foundations to the main modules and completing all the under-floor trades such as plumbing runs, heat ducts and foundation wall insulation. As the trailers used to haul modular homes are only 8 feet wide and the modular sections are usually wider, it is not possible to set the module on the trailer if a usual floor joist system is used across the top of the foundation wall. To overcome this, I use deep, flat trusses that extend from below the flooring to the bottom level of the foundation. As these are considerably stronger than floor joists, they can be spread wide enough apart so that trailer wheels can be allowed to jut up into the foundation area between the trusses, enabling the use of the lowest bed trailers; similarly, with a mobile home, the spaces between the trusses provide a location for attaching removeable wheel assemblies. Lindsay in U.S. Pat. Nos. 3,716,267 and 4,015,375 teaches that a type of flat truss can be used to allow the installation of permanent trailer skirting around a mobile home and for the hiding of under-floor plumbing. However, this does not extend down into the earth itself and does not provide for treating the foundation materials against decay. Also, wells have to be cut into the floor system to allow for transportation wheels. Also, my system permits taking the water and plumbing lines down below frost so simple connections can be made at the outside of the foundation below the frost line to street utilities, or to wells and septic tanks. In recent years, the use of the under-floor space or crawl space for a heating and cooling plenum has become popular. My attached foundation can also serve as a heating or cooling plenum system and can be much more effectively insulated than a concrete foundation.

Extra care has to be taken in the structural design of mobile and modular homes to provide for resistance to bending, twisting or warping the unit during transportation and when being set by a crane, particularly when gypsum wallboard inside finish is used. My attached foundation, because of its necessary deep depth, provides another bonus. Not only do the deep trusses provide for extra cross floor stiffness, but the trusses can be cross braced to each other and connected with lengthwise ties providing extra lengthwise stiffness. Also, diagonal bracing can be introduced, which is 45° to both the floor level and to the truss ends and sides, making the whole platform a 3-dimensional solid truss. The extra bracing necessary to produce a solid truss transportation platform will cost less than the extra plywood bracing costs to stiffen the module itself for transportation.

A problem with the addition of the attached foundation is that it can increase the height of the transportable module so that it cannot pass under overpasses, wires and hanging traffic lights. If the module is the ground floor module of a 2-story house, it will be okay. However, a pitched roof, 1-story house, or the second story of a 2-story house, would create problems. To solve this I have included a fold-down roof as part of my invention. This envisions using a 2-module gabled roof modular home, which is split into two modules along the ridge line. Each module is itself like a box, enclosed by outside walls, a marriage partition along the split line, a floor and a permanently fixed independent ceiling, which may itself be sloped for vaulted ceiling effect. The eave wall is capped with a beveled plate; beveled to the finish pitch of the roof, which is clear of the ceiling framing and insulation. The roof is in one plane consisting of a plurality of rafters which run from eave to ridge. Each rafter is attached to the beveled wall plate by means of metal strip rafter ties, which are bent when the roof is folded down, along the line of the point of the beveled plate. This effectively and very cheaply and simply, forms the means of hinging as well as the desired rafter tie-down feature and is an important feature of my invention. At the apex of each module's fold-down roof there is attached a short stub wall which extends from the top of the main center partition to the underside of the rafters at the ridge. This is built like a short partition and supports the roof in the final finished configuration. This wall is attached to the ridge board of each module by a series of metal strips. In the travelling, fold-down position, the stub wall is bent outward on the hinge strips, so it slides past the center partition. When the modules are delivered, the roof is raised and the stub wall is bent back so as to bear directly on the center partition and is permanently nailed into that configuration. This stub wall can also act as a truss to carry the roof load across doorway openings in the main center partition. If this is a wide opening, then plywood can be applied to the stub wall, turning it into a much stronger truss to span the wider openings. Another feature is that the half gables are attached to the roof and are set so as to slide by the walls at the ends of the house when the modules are being transported. Because precise fits between gable halfs on the job sites can rarely be accomplished, my invention features gables that do not cover the whole width of the half gable. A foot or so is left off at the high side and a panel, which also serves as a screened ventilation louvre, is set over the gap between the two gable parts when the house is set. Ample overlap is provided to cover any needed adjustment between the two modules.

Though I refer to modular homes, my invention would be similarly useful for mobile homes, now officially called 'manufactured homes'.

BRIEF DESCRIPTION OF DRAWINGS

In summary, the drawings illustrate the following.

DESCRIPTION OF THE PREFERRED EMBODIMENTS

Figure 1:
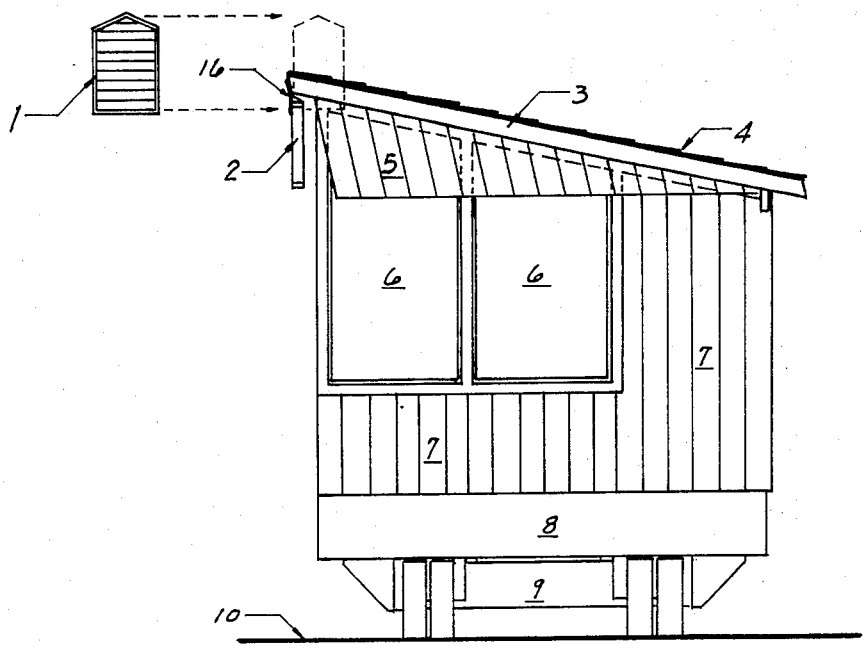
FIG. 1. Shows a half house, or a module mounted on a flat bed trailer, ready to be hauled away. The roof is in the fold-down position to facilitate passing under highway overpasses.
Figure 2:
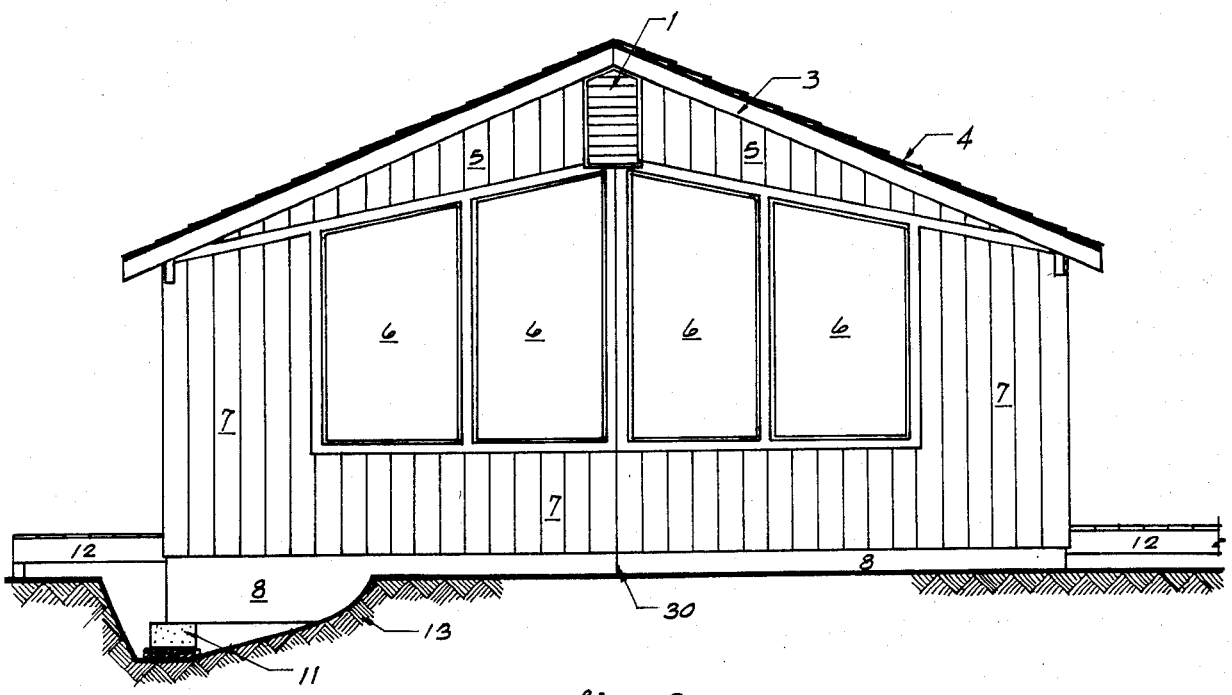
FIG. 2. Shows a completed house ready for occupancy. The roof has been lifted up in place and the wood foundation has been back-filled with earth.
Figure 3:
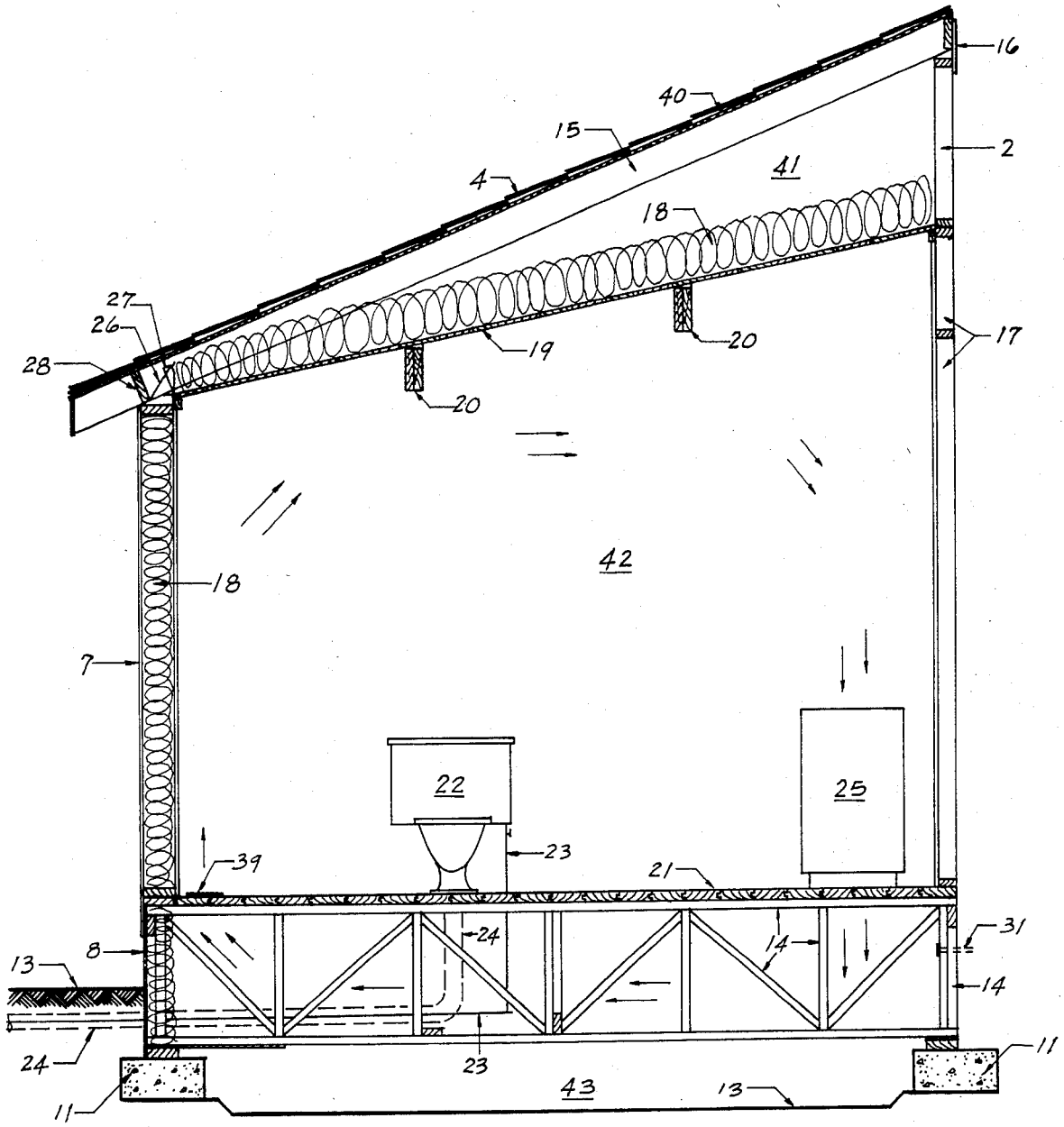
FIG. 3. Shows a cross-section of a half house, or one module, set in place. The roof is up and the excavation is back-filled. Also illustrated are plumbing and heating installations and the under-floor piping to the outside.
Figure 4:
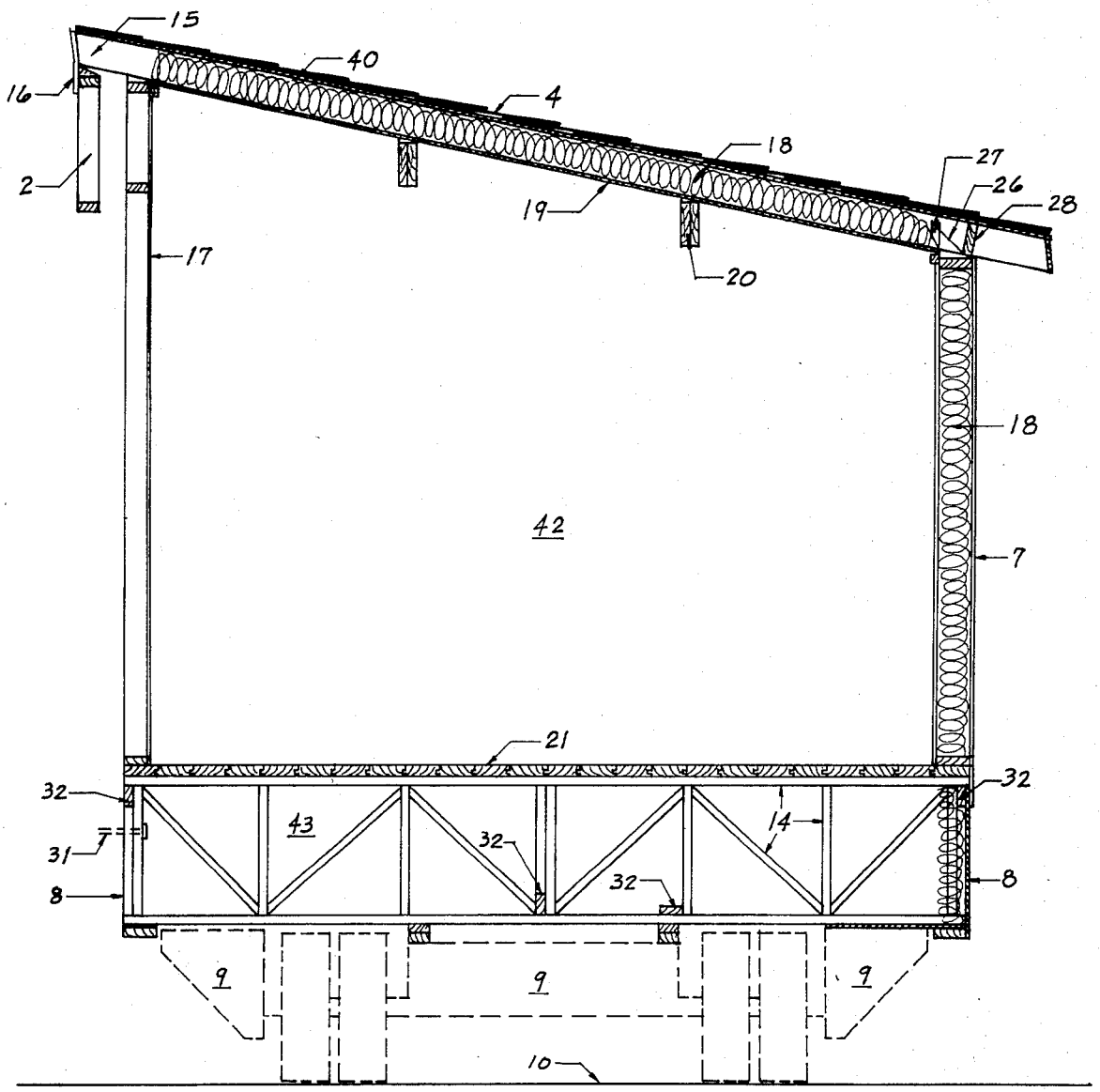
FIG. 4. Shows a cross-section of a module on a trailer in the travelling mode with the roof folded down. Also illustrated are the floor trusses which support the floor and extend down to the base of the foundation so as to provide a base for the trailer to carry the module.
Figure 5:
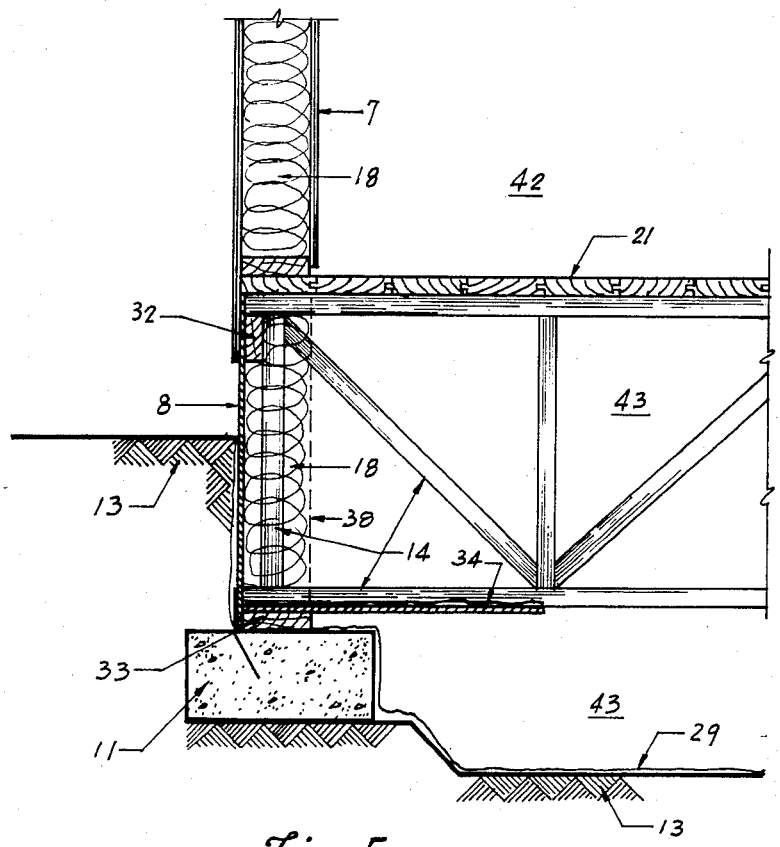
FIG. 5. Is a detailed cross-section of the all-weather wood foundation back-filled.
Figure 6:
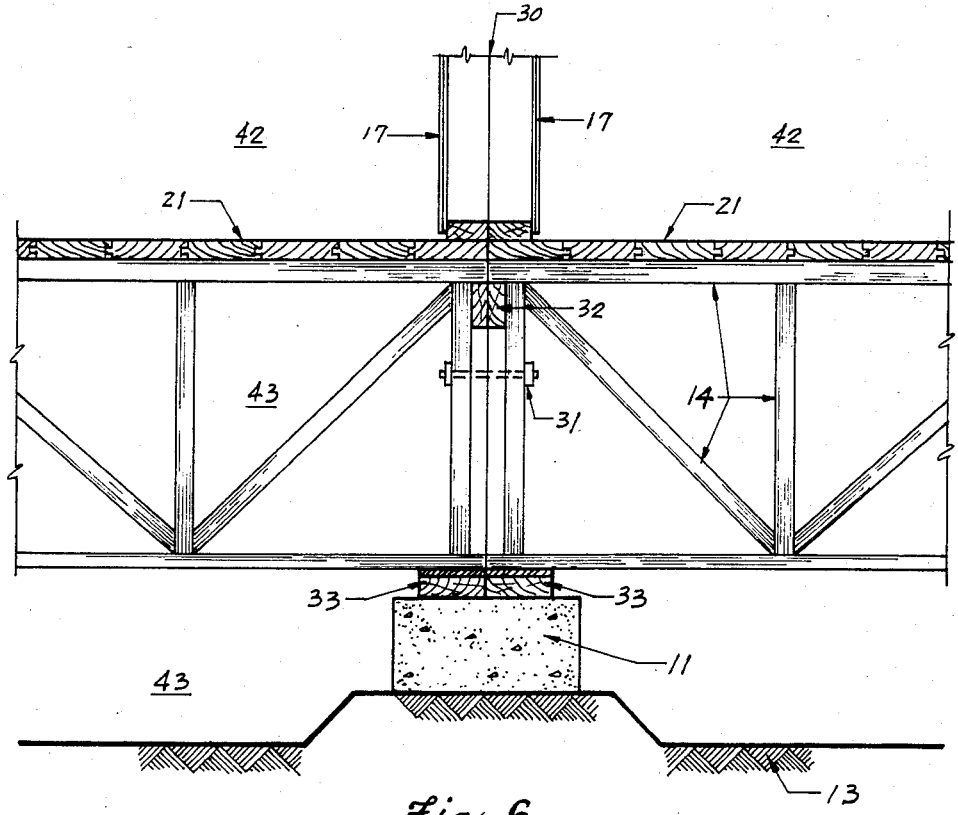
FIG. 6. Is a detailed cross-section of both module foundations at their marriage line joint.
Figure 7:
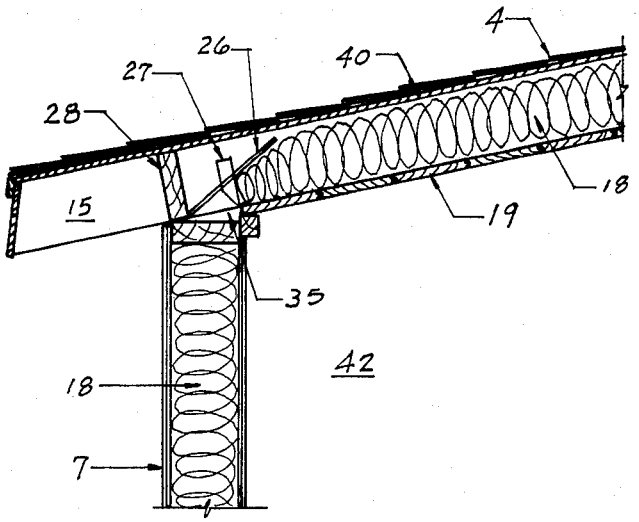
FIG. 7. Is a detailed cross-section showing the roof in its fold-down position at the module's outside eave wall.
Figure 8:
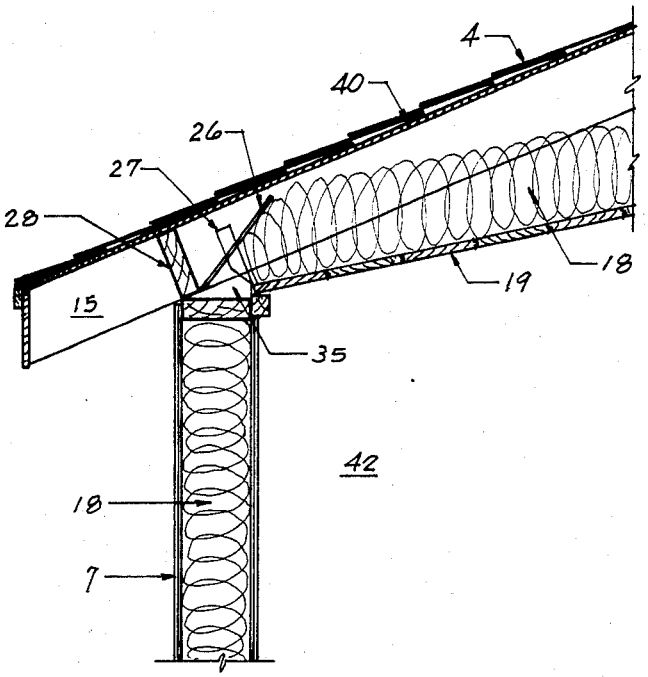
FIG. 8. Shows, in detail, how FIG. 7 changes when the roof is folded up in its permanent position.
Figures 9, 10:
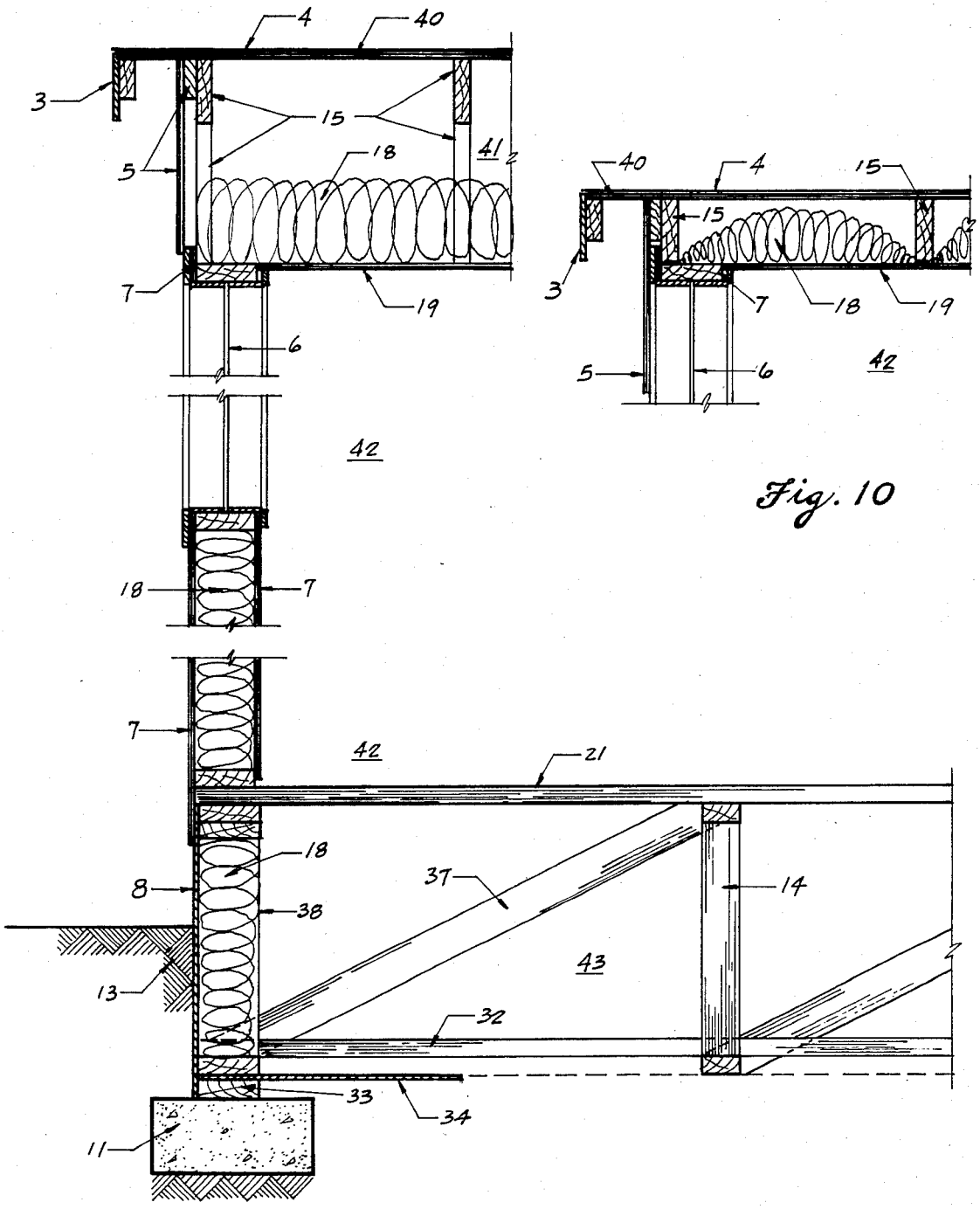
FIG. 9. Shows a detailed section of an end wall and also illustrates how the fiberglass insulation pops up after being crushed during transportation. Also shown are the braces between floor trusses.
FIG. 10. Shows a cross end section of the roof and gable in the travelling position, indicating how the fiberglass insulation is temporarily crushed during transport. It also illustrates how the gables slide down over the end wall and window when in the fold-down position.
Figure 11:
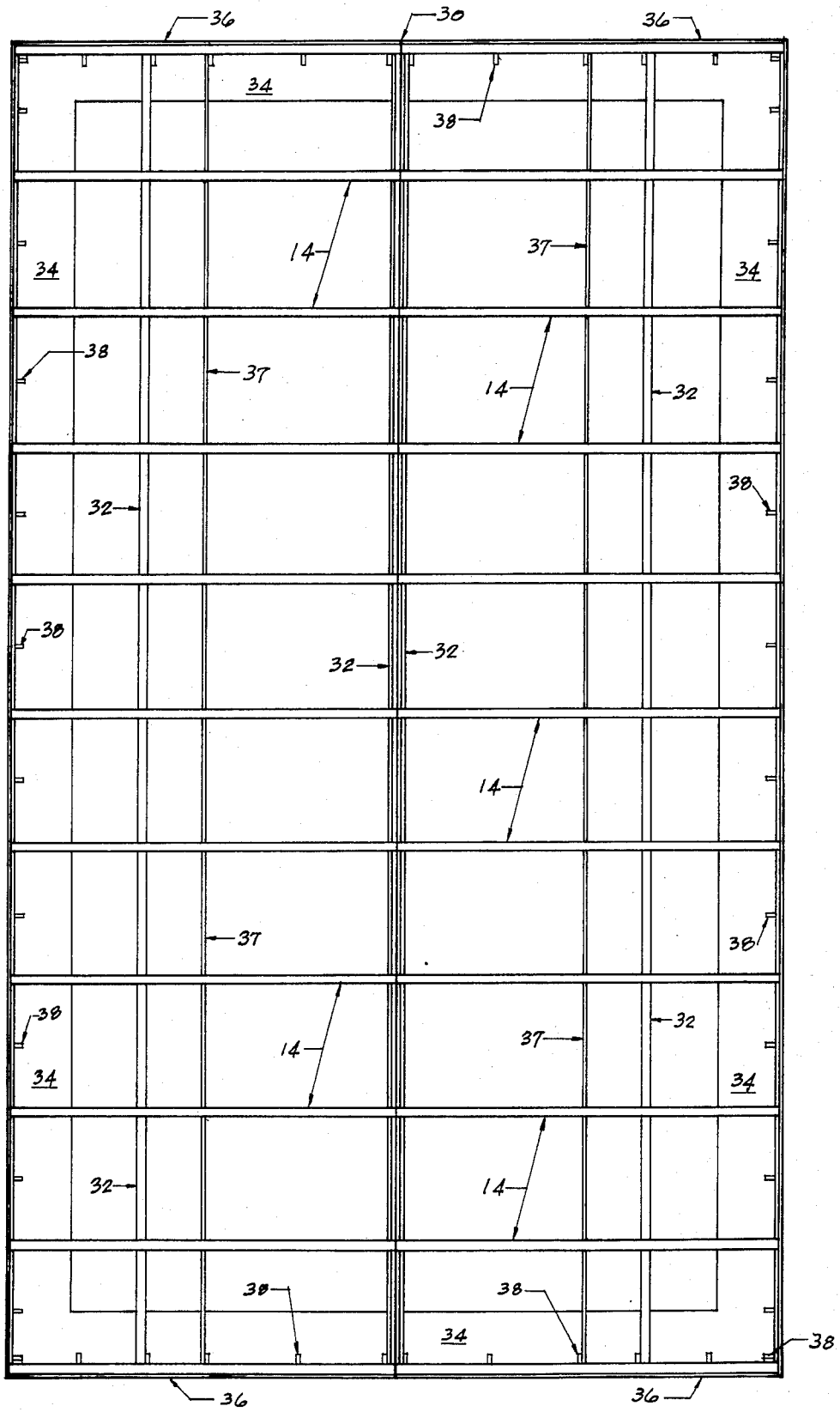
FIG. 11. Illustrates a horizontal cross-section of the foundation of both modules in the attached together final configuration. Shown are the floor trusses and their cross ties and bracing, as well as the all-weather wood foundation walls.

Throughout the drawings, the following items are identified: (1) is a ventilation gable end louver; (2) is a wall truss prop hinged to the module roof; (3) is the fascia eave trim; (4) is the roofing, or shingles; (5) is a half-gable; (6) is a window; (7) is the house wall; (8) is the attached foundation; (9) is a highway flat-bed trailer; (10) is a roadway; (11) is a permanent footing of concrete or crushed rock; (12) is a porch; (13) is the earth; (14) is a ground or floor truss; (15) is a rafter; (16) is a truss prop wall hinge; (17) is an inside partition; (18) is fiberglass insulation; (19) is the ceiling; (20) is a ceiling beam; (21) is flooring; (22) is a plumbing fixture; (23) is a water pipe; (24) is a sewage connection pipe; (25) is a furnace; (26) is an insulation baffle; (27) is a rafter tie-down and hinge; (28) is a piece of rafter blocking with a ventilation hole that is screened; (29) is a polyethylene sheet, earth moisture barrier; (30) is the marriage line between modules, or sections; (31) is a bolt joining modules at marriage line; (32) is a cross truss tie; (33) is a treated ground plate; (34) is aluminum foil reflective insulation on a plywood base; (35) is a wedge mold or plate between the sloped rafters and eave outside wall; (36) is a foundation end wall; (37) is a diagonal brace between trusses; (38) are intermediate foundation wall studs; (39) is a heating register; (40) is roof boarding; (41) is the attic area; (42) is the living area; and, (43) is the foundation area crawl space.

What I claim my invention is:

1. A transportable modular house having its foundation attached; said foundation is a sheathed 3-dimension box truss, braced longitudinally and crosswise with vertical trusses and also diagonally to form a rigid flat bottomed base for the house itself during transportation that prevents the walls, partitions and ceiling of the house from racking during transportation; said box truss foundation also serves the transportable modular home as a cavity for the placement of plumbing, heating, air conditioner, hot water storage tank and necessary piping, ducting and electric wiring, and which also serves as storage space; said box truss foundation is constructed of decay resisting material so that it can be permanently set into the ground deep enough for its flat bottom to be below the frost line for the intended geographical location of the house and be resistant to insect attack and decay while set in the earth; the bottom plane of said box truss foundation is rigid and flat so that the modular house can be set and fixed on a truck or trailer, whose flat bed is narrower and shorter than the modular house, enabling the transportation of the modular house without the overhanging box truss bending or breaking during transportation over rough roads.

2. A house as in claim 1 whose box truss foundation is constructed of wood which has been treated to resist decay.

3. A house as in claim 1 whose box truss foundation is constructed of corrosion resistant metal.

4. A house as in claim 1 whose box truss foundation has been sheathed with corrosive resistant metal mesh and covered with a water resistant cement stucco.

5. A house as in claim 1 that is built so that it can be split length-wise vertically into 2 pieces, called modules, of similar size to enable transportation via narrower roads.

6. A transportable modular home, as in claim 1, having its living space shaped like a rectangular box, the box truss bottom of which is the floor; the sides and ends are the outside walls and the top is a beamed ceiling which can be slightly sloped for effect; said box-like living space is covered with a single plane down-folding raftered roof platform set shed-like over the box, having its lower rafter ends tied to the box using common sheet metal rafter ties which can be bent hinge-like to allow the roof platform to be lowered to the ceiling level for lower transportation height; the top of the rafters of said roof platform are supported by a stub wall which is approximately one-third of the length of the rafters in height and which is also hinged and tied to the top of the rafters with simple sheet metal strips and which is set on top of the outside wall of the box to form a shed roof over the boxed living space; said stub wall has extra plywood sheathing, where necessary, to form a truss to span over larger openings in the living space wall below; said stub wall is hinged outward to allow the roof platform to be lowered and also the triangular gable ends are attached firmly to the roof platform, but set so they are just clear of the box-end walls and can slide over them when the roof platform is lowered; said modular home can be restored to its shed-like permanent state after transportation by lifting the hinged roof platform up at its top edge, setting the stub wall back permanently to the top of the lower living area wall and firmly attaching the sliding gables to the end living area walls.

7. A transportable modular home using a pair of modules which are mirror images in shape, and similar to the modular home described in claim 1, which, when together, form a more acceptable peaked roof in which the two higher side walls are placed together forming what is called a marriage partition between the two halves of the house.

8. A module as in claim 1, which can have a detachable second story module over the main floor module, creating a 2-story modular house.

* * * * *